US010937604B2

(12) United States Patent
Vacirca et al.

(10) Patent No.: US 10,937,604 B2
(45) Date of Patent: Mar. 2, 2021

(54) SWITCHING DEVICE FOR A MV ELECTRIC POWER DISTRIBUTION NETWORK

(71) Applicant: ABB Schweiz AG, Baden (CH)

(72) Inventors: Leandro Vacirca, Dalmine (IT); Angelo Cleber, Dalmine (IT); Luciano Di Maìo, Milan (IT)

(73) Assignee: ABB Schweiz AG, Baden (CH)

( * ) Notice: Subject to any disclaimer, the term of this patent is extended or adjusted under 35 U.S.C. 154(b) by 394 days.

(21) Appl. No.: 15/320,664

(22) PCT Filed: Apr. 22, 2015

(86) PCT No.: PCT/EP2015/058698
§ 371 (c)(1),
(2) Date: Dec. 20, 2016

(87) PCT Pub. No.: WO2015/193006
PCT Pub. Date: Dec. 23, 2015

(65) Prior Publication Data

US 2017/0194111 A1 Jul. 6, 2017

(30) Foreign Application Priority Data

Jun. 18, 2014 (EP) ..... 14172992

(51) Int. Cl.
*H01H 9/16* (2006.01)
*H01H 33/12* (2006.01)
(Continued)

(52) U.S. Cl.
CPC ..... *H01H 9/161* (2013.01); *H01H 31/28* (2013.01); *H01H 33/127* (2013.01);
(Continued)

(58) Field of Classification Search
CPC ..... H01H 9/161; H01H 33/127; H01H 31/28; H01H 71/12; H01H 75/04; H01H 71/123;
(Continued)

(56) References Cited

U.S. PATENT DOCUMENTS 1,394,968 A 10/1921 Christensen
4,451,910 A 5/1984 Simard
(Continued)

FOREIGN PATENT DOCUMENTS

WO 2012162374 A1 11/2012

OTHER PUBLICATIONS

European Patent Office, Examination Report in corresponding Application No. 14172992.1, dated Jul. 11, 2018, 5 pp.
(Continued)

*Primary Examiner* — Daniel J Cavallari
(74) *Attorney, Agent, or Firm* — Taft Stettinius & Hollister LLP

(57) ABSTRACT

The invention relates to a switching device for a MV electric power distribution network. The switching device comprises electric contacts, which are electrically connectable to a conductor of said electric power distribution network, and a
(Continued)

control unit. The switching device comprises signalling means emitting visible light externally to said switching device, said signalling means being controlled by said control unit.

10 Claims, 5 Drawing Sheets

(51) Int. Cl.

| | |
|---|---|
| ***H01H 31/28*** | (2006.01) |
| ***H01H 71/12*** | (2006.01) |
| *H01H 75/04* | (2006.01) |
| *H01H 33/42* | (2006.01) |
| *H01H 33/02* | (2006.01) |

(52) U.S. Cl.
CPC ..... *H01H 71/12* (2013.01); *H01H 9/168* (2013.01); *H01H 33/027* (2013.01); *H01H 33/423* (2013.01); *H01H 71/123* (2013.01); *H01H 75/04* (2013.01); *H01H 2219/06* (2013.01); *H01H 2219/066* (2013.01)

(58) Field of Classification Search
CPC .... H01H 9/168; H01H 33/423; H01H 33/027; H01H 2219/06; H01H 2219/066
See application file for complete search history.

(56) References Cited

U.S. PATENT DOCUMENTS

| | | | | |
|---|---|---|---|---|
| 4,553,188 | A | 11/1985 | Aubrey et al. | |
| 5,754,386 | A * | 5/1998 | Barbour | H02H 3/247 361/154 |
| 5,996,079 | A * | 11/1999 | Klein | G06F 1/26 713/300 |
| 7,079,367 | B1 * | 7/2006 | Liljestrand | H01H 79/00 361/62 |
| 8,988,020 | B1 * | 3/2015 | Rometo | H01H 33/36 318/268 |
| 2004/0252421 | A1 | 12/2004 | Knox, Jr. et al. | |
| 2005/0024218 | A1 | 2/2005 | Cuk | |
| 2014/0046400 | A1 * | 2/2014 | Roy | A61N 1/36046 607/54 |
| 2014/0063674 | A1 * | 3/2014 | Ghoreishi | H01H 33/36 361/115 |
| 2015/0316589 | A1 * | 11/2015 | Mazara Diaz | G01R 19/165 324/114 |

OTHER PUBLICATIONS

International Search Report and Written Opinion, PCT/EP2015/058696, ABB Technology AG, Aug. 4, 2015, 9 pages.

* cited by examiner

SWITCHING DEVICE FOR A MV ELECTRIC POWER DISTRIBUTION NETWORK

The present invention relates to a switching device for medium voltage (MV) power distribution networks.

Within the framework of the present invention, the term "medium voltage" relates to voltages higher than 1 kV AC and 1.5 kV DC and lower than 72 kV AC and 100 kV DC.

As is known, switching devices, such as automatic sectionalizers, are operatively associated to the phase conductors of a MV electric power distribution network to automatically restore or interrupt the electric continuity of this latter.

Generally, automatic sectionalizers cannot operate when fault currents (e.g. short-circuit currents or overload currents) flow along the phase conductors. Fault currents are in fact typically interrupted by properly arranged circuit breakers or reclosers.

Nowadays, an operator is not able to know whether a traditional sectionalizer has been properly installed on the field before this latter starts operating.

The blind commissioning of these devices has remarkable drawbacks, since it may lead to undesired electric power outages of large branches of the electric power distribution network.

These problems are even more critical when a sectionalizer is installed in outdoor overhead electric power distribution lines, for which maintenance interventions are quite time consuming and expensive.

A way to face this issue is to provide the control unit of the sectionalizer with a communication module, which allows it to be wireless interrogated by a remote device.

This solution entails an increase of the overall size and industrial costs of the switching device, which may be unacceptable in some applications.

In the market, it is thus still felt the need for technical solutions that are capable of overcoming the technical issues described above.

In order to respond to this need, the present invention provides a switching device for a MV electric power distribution network, according to the following claim 1 and the related dependent claims.

Further characteristics and advantages of the present invention shall emerge more clearly from the description of preferred but not exclusive embodiments thereof, illustrated purely by way of example and without limitation in the attached drawings, in which.

Figure 4:
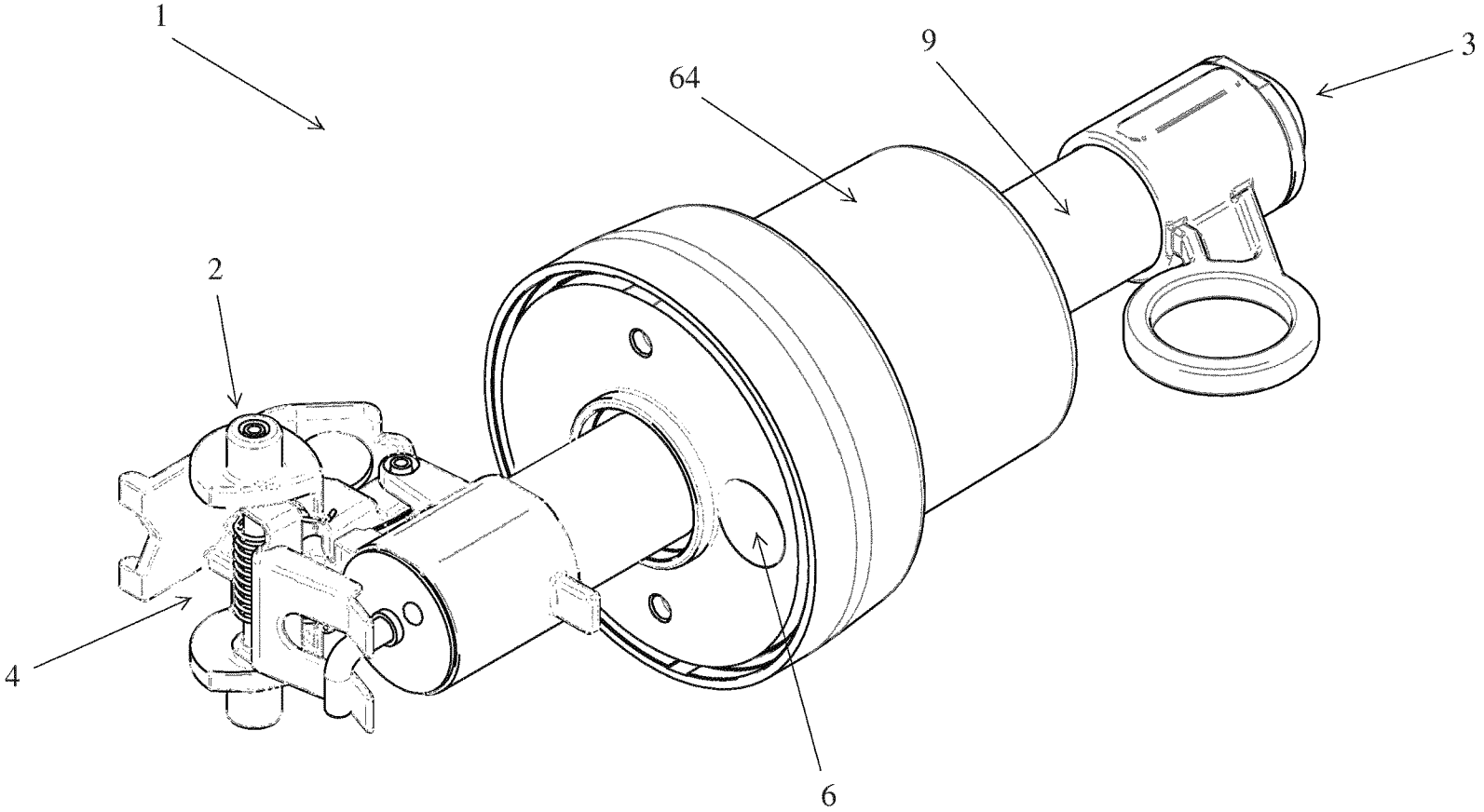
Figure 5:
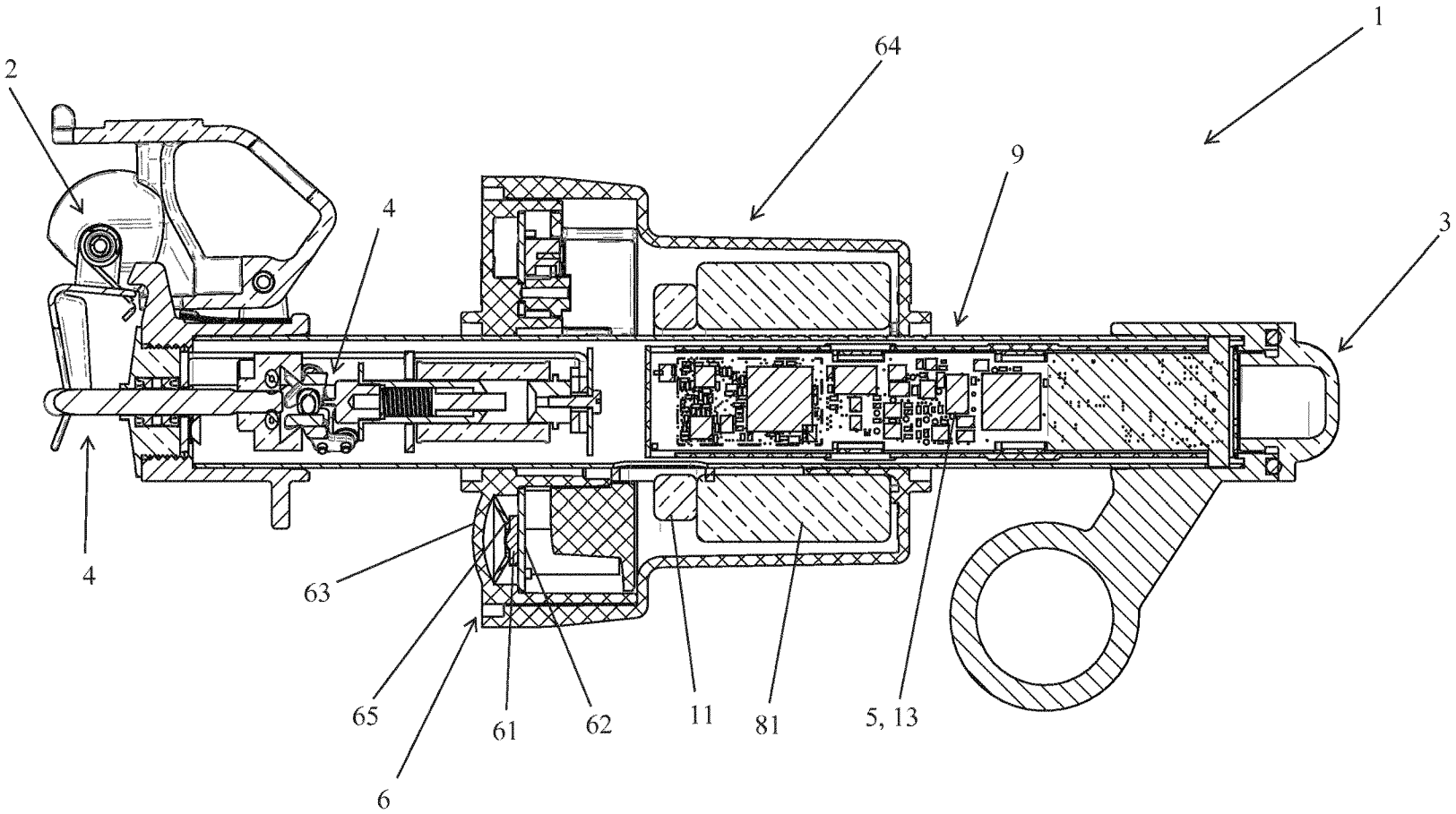

FIGS. 4-5 schematically show an embodiment of the switching device, according to the present invention.

With reference to the mentioned figures, the present invention relates to a switching device 1 for a MV electric power distribution network 100, e.g. an overhead MV power distribution line.

Figure 2:
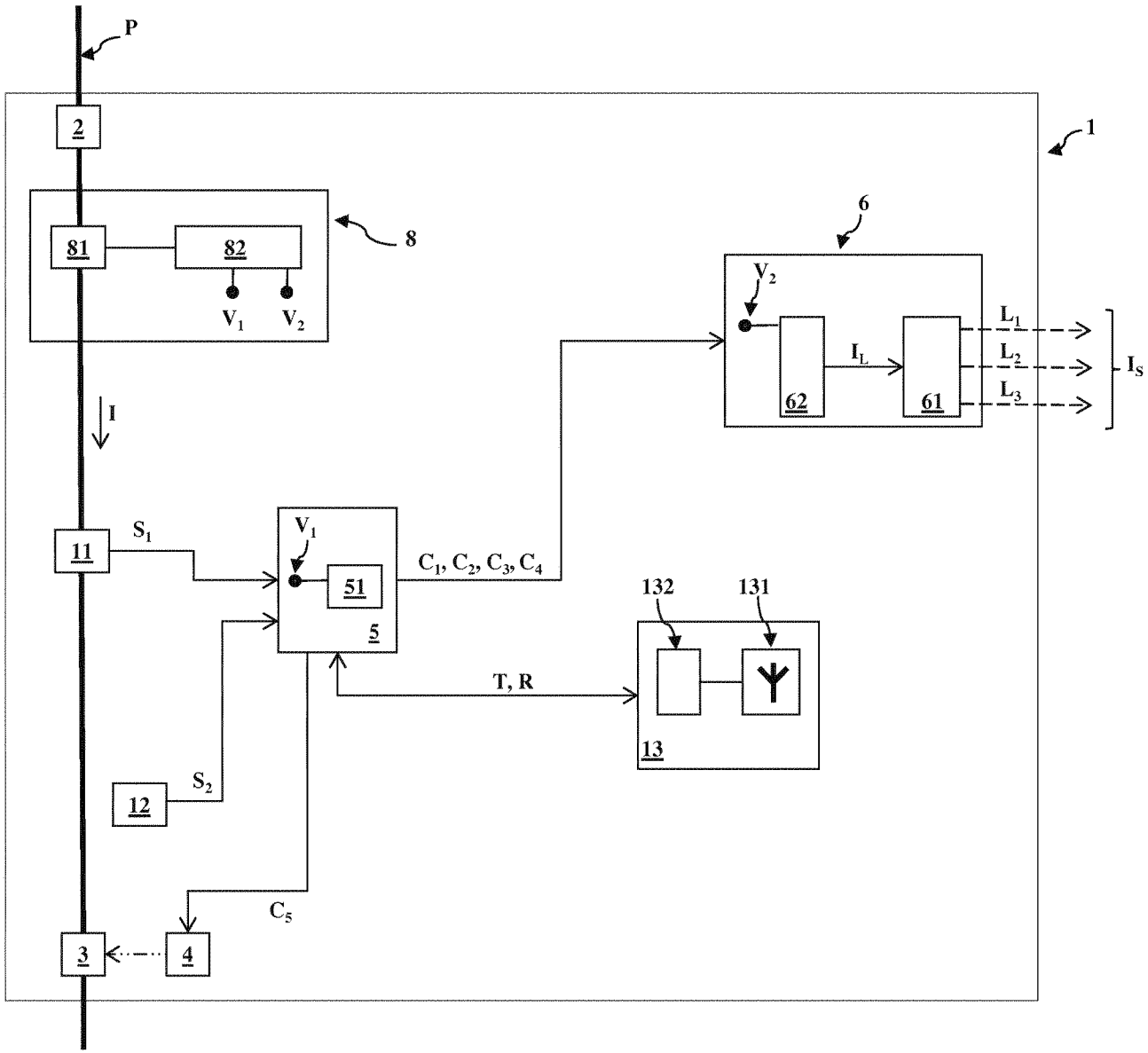
FIG. 2 is a diagram that schematically shows the structure of the switching device, according to the present invention.

The switching device 1 is operatively associated to a conductor P of the electric power distribution network 100, which is preferably a phase conductor (FIG. 2).

The switching device 1 comprises electric contacts 2, 3 that are electrically connectable to the conductor P.

In operation, at least one of said electric contact (e.g. the electric contact 3) can be separated from a corresponding electric contact (not shown) of the conductor P, so that the electrical continuity of upstream and downstream portions (referring to the position of the disconnectable electric contact 3) of the conductor P can be interrupted.

Figure 1:
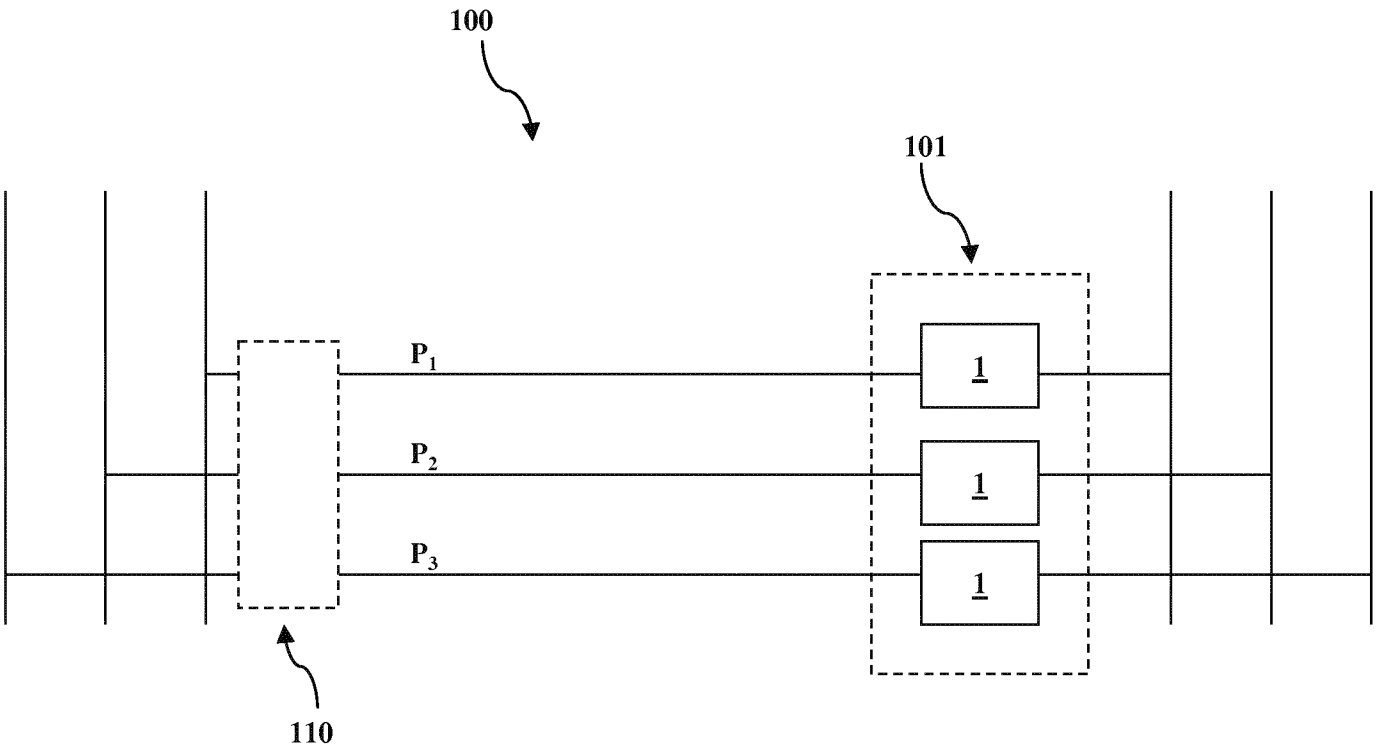
FIG. 1 is a diagram that schematically shows a MV electric power distribution network comprising a plurality of switching devices, according to the present invention, operatively associated to the phase conductors.

In general, the switching device 1 is capable to interrupt currents along the conductor P and is advantageously arranged to intervene in coordination with at least a circuit breaker or recloser 110 that is operatively associated to the electric power distribution network 100 to provide protection against short-circuit currents and/or overload currents (FIG. 1).

Preferably, the switching device 1 is an automatic sectionalizer, e.g. for an overhead power distribution line.

The switching device 1 advantageously comprises release means 4 to allow separation of at least one of said electric contacts (e.g. the electric contact 3) from the conductor P.

The release means 4 may comprise an electro-mechanical or electro-magnetic release device or actuator, which is tripped by suitable control signals $C_5$.

The switching device 1 comprises a control unit 5, which preferably comprises a digital processing device 51 (for example a microcontroller) that is capable to execute software instructions (stored in a memory) for managing the operating life of the switching device 1, e.g. for generating/receiving data signals, processing data, generating/receiving control signals and the like.

The control unit 5 may comprise further electronic circuits (not shown) operatively connected to the digital processing device 51.

According to the invention, the switching device 1 comprises signalling means 6 operatively connected to the control unit 5, so as to be controlled by this latter (in particular by the digital processing device 51).

The signalling means 6 comprise a light source 61 adapted to emit visible light.

Preferably, the light source 61 emits red light. This solution ensures improved light transmission efficiency and it is particularly suitable for outdoor installations.

In some embodiments of the invention, the light source 61 is adapted to emit visible light of different colours (preferably including red colour).

Preferably, the light source 61 comprises one or more LEDs (Light Emitting Diodes).

Preferably, the signalling means 6 comprise a driving circuit 62, which is electrically connected with the light source 61 and the control unit 5.

The driving circuit 62 is adapted to receive suitable control signals (e.g. the control signals $C_1$, $C_2$, $C_3$, $C_4$ mentioned in the following) from the control unit 5 and provide one or more driving signals $I_L$ to the light source 61 to operate this latter in response to said control signals.

As an example, when the light source 61 comprises one or more LEDs, the driving circuit 62 is capable to provide suitable driving currents $I_L$ to operate said LEDs in response to control signals received from the control unit 5.

The light source 61 is arranged so that the emitted light is observable from the external of the switching device 1, e.g. by an operator accessing to the site where the switching device 1 is installed.

The switching device 1 comprises an accessory module 64 that accommodates the signalling means 6 (FIGS. 4-5).

Advantageously, the module 64 is positioned so that the light source 61 can emit light towards the environment external to the switching device 1.

Preferably, the light source 61 is optically coupled to an optical lens 63 and to a reflecting body 65, which are part of said signalling means 6.

Conveniently, the lens 63 forms an external transparent wall portion of the module 64, through which the light source 61 can emit light.

The reflecting body 65 improves light transmission whereas the lens 63 allows reducing light dispersion phenomena and ensures protection against external environmental agents.

As mentioned above, the functioning of the signalling means 6 is controlled by the control unit 5.

According to the invention, the control unit 5 is adapted to provide one or more control signals $C_1$, $C_2$, $C_3$ to the signalling means 6, so that the light source 61 emits one or more light signals $L_1$, $L_2$, $L_3$ indicative of corresponding operating conditions $CON_1$, $CON_2$ of the switching device 1.

In other words, the signalling means 6 are controlled by the control unit 5 in such a way that the light source 61 emits light signals $L_1$, $L_2$, $L_3$ providing (when visually observed) coded information $I_S$ about corresponding operating conditions of the switching device 1.

Preferably, the control unit 5 sends the control signals $C_1$, $C_2$, $C_3$ to the driving circuit 62, which generates suitable driving signals $I_L$ to operate the light source 61 in response to said control signals, so that the light source 61 generates the light signals $L_1$, $L_2$, $L_3$.

Preferably, the control unit 5 is adapted to provide first control signals $C_1$ to the signalling means 6, so that the light source 61 emits first pulsed light signals $L_1$ having one or more first sequences $T_1$ of light pulses indicative of first corresponding operating conditions $CON_1$ of the switching device 1, during a start-up functioning of this latter.

Within the framework of the present invention the term "start-up functioning" relates to the customary functioning of the switching device 1 before its entering into service, i.e. during or immediately after its installation on the field.

Preferably, the control unit 5 generates the control signals $C_1$ after having performed an internal check (preferably as soon as it starts operating) or in response to data/control signals received from other devices.

Preferably, the first sequences $T_1$ of light pulses are configured to provide coded information $I_S$ indicative of the corresponding operating conditions $CON_1$.

During each sequence $T_1$, the light source 61 emits light pulses having a given time distribution. Such a time distribution is the parameter providing observable coded information $I_S$ indicative of a corresponding operating condition $CON_1$.

The first light signals $L_1$ may be indicative of a correct configuration of the control unit 5 or about possible faults.

By observing the light signals $L_1$, an operator can easily learn whether the switching device 1 has been properly installed, whether the commissioning of the switching device 1 has been successful, whether the configuration settings of the control unit 5 have been accepted, and the like.

Visual information $I_S$ provided by the light signals $L_1$ is quite useful to increase the confidence that the switching device 1 has been properly installed and works correctly, thereby increasing the reliability of the installation.

This brings remarkable advantages, particularly when the switching device 1 is installed in overhead lines.

Preferably, the control unit 5 is adapted to provide second control signals $C_2$ to the signalling means 6, so that the light source 61 emits second pulsed light signals $L_2$ having one or more second sequences $T_2$ of light pulses indicative of corresponding second operating conditions $CON_2$ of the switching device 1, during a normal functioning of this latter.

Within the framework of the present invention, the term "normal functioning" relates to the customary functioning of the switching device 1 after its entering into service.

Preferably, the control unit 5 generates the control signals $C_2$ after having performed an internal check (preferably at given time intervals) or in response to data/control signals received from other devices (e.g. sensors operatively connected to the control unit 5).

Preferably, the second sequences $T_2$ of light pulses are configured to provide coded information $I_S$ indicative of the corresponding operating conditions $CON_2$.

During each sequence $T_1$, the light source 61 emits light pulses having a given time distribution. Such a time distribution is the parameter providing observable coded information $I_S$ indicative of a corresponding operating condition $CON_2$.

The light signals $L_2$ may be indicative of recent manoeuvres of the switching device 1 or measured electrical quantities (e.g. of the current I flowing along the conductor P).

By observing the light signals $L_2$, an operator can immediately learn whether the switching device 1 works properly, during its normal functioning period.

Visual information $I_S$ provided by the light signals $L_2$ is quite useful to understand electric power balance across a line branch, identify critical overloads or persisting line fault conditions or persistent transient faults.

This facilitates planning of maintenance interventions, thereby reducing maintenance time and costs.

As mentioned above, the first and second sequences $T_1$, $T_2$ of light pulses of the first and second light signals $L_1$, $L_2$ comprise light pulses having given time distributions corresponding to given operating conditions $CON_1$, $CON_2$ of the switching device 1.

In some embodiments of the invention, each sequence $T_1$, $T_2$ of light pulses comprises a given number of light pulses (said number providing the coded information $I_S$), which corresponds to a given operating condition $CON_1$, $CON_2$ of the switching device 1.

In other embodiments of the invention, each sequence $T_1$, $T_2$ of light pulses comprises light pulses having a given duty-cycle (said duty-cycle providing the coded information $I_S$), which corresponds to a given operating condition $CON_1$, $CON_2$ of the switching device 1.

Preferably, each sequence $T_1$, $T_2$ comprises light pulses having a given frequency F (said frequency providing the coded information $I_S$), which corresponds to a given operating condition $CON_1$, $CON_2$ of the switching device 1.

Obviously, the control unit 5 may provide different kinds of first and second control signals $C_1$, $C_2$ to the signalling means 6, so that the light source 61 emits different kinds of first and second pulsed light signals $L_1$, L2.

Each different light signal $L_1$, $L_2$ is characterised by a corresponding sequence $T_1$, $T_2$ of light pulses, which is configured to be indicative of a corresponding operating condition $CON_1$, $CON_2$ of the switching device 1.

Preferably, the sequences of light pulses $T_1$, $T_2$ are repeated at given time intervals, so that they can be easily observed by an operator.

It is observed that a missing emission of the light signals L1, L2 by the light source 61 may per se be indicative of the presence of faults. Thus, an operator can acquire information on the operating conditions of the switching device 1 even when the signals $L_1$, $L_2$ cannot be observed.

Figure 3:
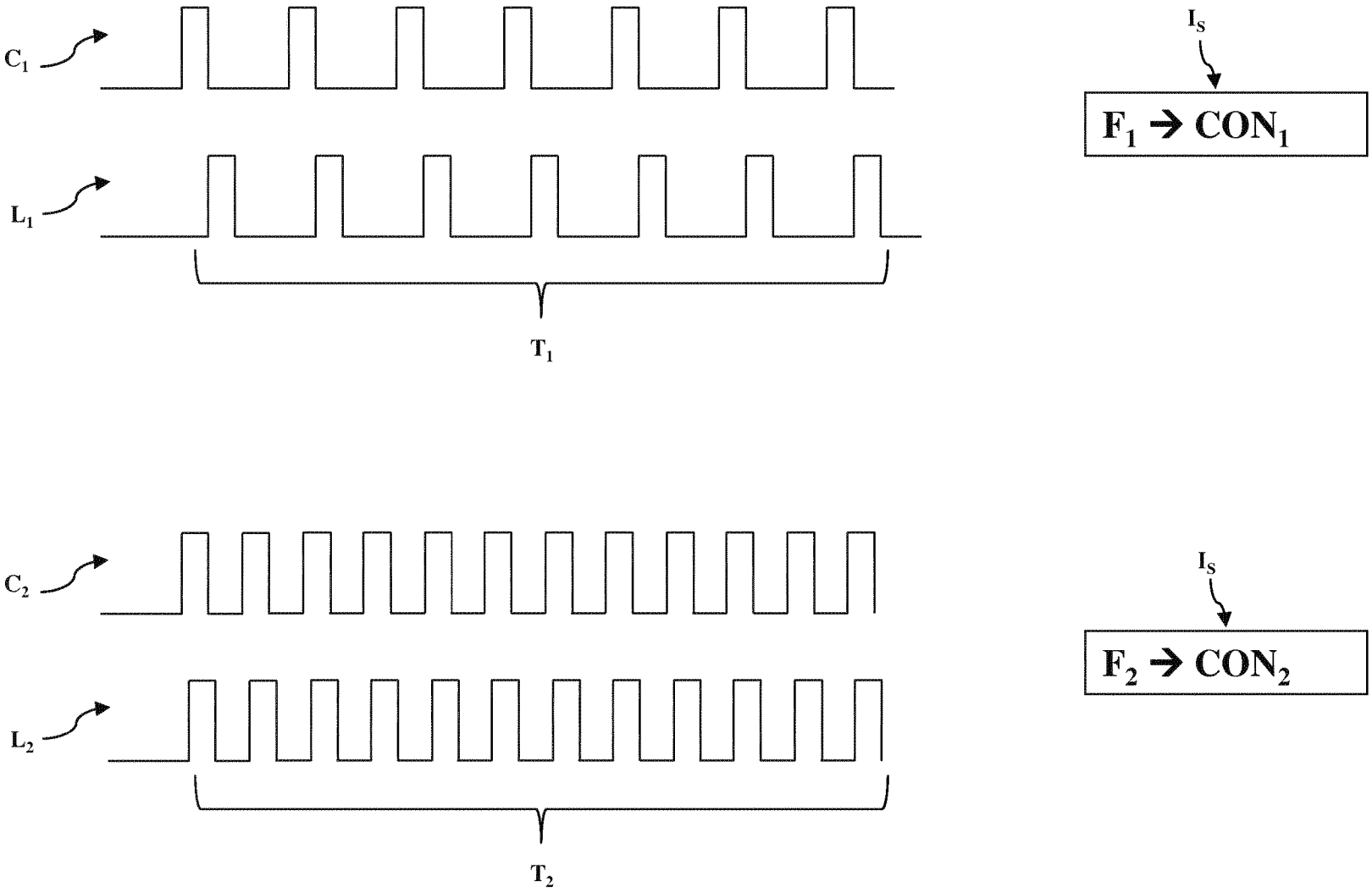
FIG. 3 is a diagram that schematically shows the functioning of the switching device, according to the present invention.

An example of functioning of the switching device 1 is shown in FIG. 3.

In this example, the light source 61 is supposed to comprise a single LED.

The switching device 1 is capable of providing visual information of its operating conditions before its entering into service.

At a start-up functioning of the switching device 1 (e.g. immediately after the commissioning), the control unit 5 executes an internal check of the operating conditions of the switching device 1.

In response to said internal check, the control unit 5 provides the driving circuit 62 with a first control signal $C_1$ having the shape of square wave.

In this case, the first control signal $C_1$ has a given first duty cycle $DC_1$ and a given first frequency $F_1$.

In response to the control signal $C_1$, the driving circuit 62 generates a driving current $I_L$ to operate the LED 61.

The LED 61 emits a first pulsed light signal $L_1$ having a first sequence $T_1$ of light pulses characterised by a frequency $F_1$ and duty cycle $DC_1$.

The sequence $T_1$ of light pulses is advantageously repeated periodically.

In this case, the duty cycle $DC_1$ of the light pulses may be advantageously selected to reduce power consumption (without providing any useful information content).

Instead, the frequency $F_1$ of the light pulses is advantageously selected to be indicative of a first corresponding coded operative condition $CON_1$ of the switching device 1.

For example, the frequency $F_1$ may be selected to indicate an operative state of the switching device 1, which corresponds to a correct and complete installation.

By simply observing the blinking light signal $L_1$ emitted by LED 61, an operator can thus acquire information $I_S$ related to an operative condition of the switching device 1, before its entering into service.

On the other hand, if the blinking signal $L_1$ is not emitted, the operator will understand that a fault occurred during the commissioning of the switching device 1.

Of course, the signalling means 6 may be controlled by the control unit 5, so that the light source 61 emits pulsed light signals $L_1$ having different frequencies of the light pulses, each frequency corresponding to a given operating condition $CON_1$ of the switching device 1.

For example, different pulsed light signals $L_1$ indicating different typology of faults may be emitted.

It is also understood that, in general, the sequences $T_1$ of light pulses (or the light pulses themselves) of the light signals $L_1$ may be differently shaped or may have different time distributions from those shown in FIG. 3, depending on the parameter selected (frequency, duty-cycle, duration, etc.) to provide coded information $I_S$ indicative of corresponding operating conditions $CON_1$ of the switching device 1.

The switching device 1 is capable of providing visual information of its operating conditions after its entering into service.

During the normal operating life of the switching device 1, the control unit 5 executes periodically an internal check or receives data signals indicative of measured electrical quantities.

In response to said internal check or data signals, the control unit 5 provides the driving circuit 62 with a second control signal $C_2$, which makes the LED 61 to emit a second pulsed light signal $L_2$ having a second sequence $T_2$ of light pulses characterised by a second frequency $F_2$.

The frequency $F_2$ of the light pulses is advantageously selected to be indicative of a second coded operative condition $CON_2$ of the switching device 1.

For example, the frequency $F_2$ may be selected to indicate that a manoeuvre of the switching device 1 has occurred or to provide a measurement value in coded form.

Again by simply observing the blinking light signal $L_2$ emitted by LED 61, an operator can acquire information $I_S$ related the actual operative status of the switching device 1.

Also in this case, the signalling means 6 may be controlled by the control unit 5, so that the light source 61 emits pulsed light signals $L_2$ having different frequencies of the light pulses, each frequency corresponding to a given operating condition $CON_2$ of the switching device 1. Further, in general, the sequences $T_2$ of light pulses (or the light pulses themselves) of the light signals $L_2$ may be differently shaped or may have different time distributions from those shown in FIG. 3, depending on the parameter selected (frequency, duty-cycle, duration, etc.) to provide coded information $I_S$ indicative of the corresponding operating conditions $CON_2$ of the switching device 1.

According to an embodiment of the invention, the switching device 1 comprises first sensing means 11 operatively connected to the control unit 5.

The sensing means 11 provide first sensing signals $S_1$ indicative of the current I flowing along the conductor P to the control unit 5.

Preferably, the sensing means 11 comprise a measuring current transformer that is operatively coupled to the conductor P and is electrically connected to the processing means 51.

The control unit 5 is advantageously adapted to provide the second control signals $C_2$ to the signalling means 6 in response to the sensing signals $S_1$ received from the sensing means 11.

In this case, the signalling means 6 are operated by the control unit 5, so that the light source 61 emits light signals $L_2$ indicative of corresponding ranges of values of a current I flowing along the conductor P, during the normal functioning of the switching device 1.

Advantageously, the light source 61 provides light signals $L_2$ having a second sequence $T_2$ of light pulses (repeated periodically) characterised by a frequency of the light pulses that varies according to the measured current range for the current I.

If the current range of the current I varies, the frequency of the light pulses will vary accordingly. Thus, a given frequency will be indicative of a first range of current values whereas other frequencies will be indicative of other corresponding ranges of current values.

By observing the blinking light signals $L_2$ emitted by the light source 61, an operator can immediately acquire information on the magnitude of the current I along the conductor P.

Even if the linking signals $L_2$ does not provide precise measurements of the current I, they provide useful information for managing the operation of the switching device 1 and for safety purposes.

As mentioned above, the light source 61 may be advantageously adapted to emit light signals of different colours.

For example, the light source 61 may comprise a plurality of LEDs emitting light of different colours.

Preferably, the control unit 5 is adapted to provide third control signals $C_3$ to the signalling means 6 to operate these latter, so that the light source 61 emits third light signals $L_3$ having colours indicative of corresponding operating conditions $CON_1$, $CON_2$ of the switching device 1.

In this case, the colour of the light signals $L_3$ is the parameter providing coded information $I_S$ related to the operating conditions $CON_1$, $CON_2$ of the switching device 1.

As an example, a light signal $L_3$ of a given colour may be indicative of the recent occurrence of faults or it may indicate the main direction of electric power flow along the conductor P or the like.

In a possible embodiment, the signalling means 6 are operated so that the light source 61 emits third light signals $L_3$ having different colours, wherein each of said colours is indicative of a corresponding operating condition $CON_1$, $CON_2$ of the switching device 1.

Preferably, in case the light source 61 comprises a plurality of LEDs capable of emitting different colours, the signalling means 6 are operated by the control unit 5, so that one or more main LEDs emit first or second pulsed light signals $L_1$, $L_2$ of a same given colour (preferably a red colour) and one or more auxiliary LEDs emit third light signals $L_3$ of different colours, each colour being indicative of a corresponding operating condition $CON_1$, $CON_2$ of the switching device 1.

Preferably, the control unit 5 is capable of operating the signalling means 6, so as to vary the light intensity of the light signals $L_1$, $L_2$, $L_3$ emitted by the light source 61.

In particular, the control unit 5 is adapted to provide one or more fourth control signals $C_4$ to the signalling means 6, so that the light source 61 emits light signals $L_1$, $L_2$, $L_3$ of variable light intensity.

Preferably, the switching device 1 comprises second sensing means 12 operatively connected to the control unit 5.

The sensing means 12 provide second sensing signals $S_2$ indicative of the environmental light external to the switching device 2.

Preferably, the sensing means 12 comprise a light sensor that is arranged so as to detect the environmental light out of the switching device 1.

Preferably, the control unit 5 provide the control signals $C_4$ in response to the sensing signals $S_2$.

In this way, the signalling means 6 are operated so that the light source 61 emits light signals $L_1$, $L_2$, $L_3$ having a light intensity that varies as a function of the external environmental light, e.g. depending on the daytime or weather conditions.

Preferably, the control unit 5 is adapted to provide one or more fifth control signals $C_5$ to control the actuation means 4. In this way, the control unit 5 can control the manoeuvres of the electric contacts 2, 3, according to the needs.

Preferably, the switching device 1 comprises a communication unit 13 operatively connected to the control unit 5.

The communication unit 13 is provided with at least an antenna element 131 for wireless communication with other remote devices.

The communication unit 13 is capable of wireless communicating with other remote devices (not shown), e.g. with the control units of other switching devices, Intelligent Control Devices (IEDs), relays, SCADA systems or the like.

The communication unit 13 is capable of managing the wireless communication with said remote devices, e.g. by means of suitable communication protocols such as Zigbee™, Bluetooth™ or the like.

The communication unit 13 is controlled by the control unit 5 and can interact with this latter for managing the wireless communication with the remote devices.

The communication unit 13 preferably comprises an interface circuit 132 that is operatively connected with the control unit 5 for sending/receiving transmission/reception signals to/from this latter.

The control unit 5 is adapted to generate one or more transmission signals T for the interface circuit 132.

Transmission signals T may comprise command signals for the interface circuit 132 and/or data signals (e.g. data packages) to be transmitted by the interface circuit 132 via the antenna unit 131.

The control unit 5 is adapted to receive one or more reception signals R from the interface circuit 131.

Reception signals R may comprise command signals and/or data signals (e.g. data packages) for the processing means 51, which have been generated by the interface circuit 131 and/or which have been received by the interface circuit 132 from remote devices, via the antenna unit 131.

Preferably, the switching device 1 comprises a power supply unit 8, which is operatively connected to the control unit 5 and to the signalling means 6 to provide electric power to these latter.

Preferably, the switching device 1 is of the "self-supplied" type, i.e. it comprises a power supply unit 8 that is capable to draw electric power to feed the internal components from the conductor P, to which the switching device 1 is operatively associated.

Preferably, the power supply unit 8 comprises a first power harvesting circuit 81, which is operatively coupled to the conductor P to draw electric power from this latter.

Preferably, the power harvesting circuit 81 comprises a current transformer electrically connected to one or more interface circuits.

Preferably, the power supply unit 8 comprises a second power supply circuit 82, which is electrically connected to the first power harvesting circuit 81.

Preferably, the power supply unit 8 is capable to provide a first power supply voltage $V_1$ to feed the control unit 5 (in particular the processing device 51) and a second power supply voltage $V_2$ to feed the signalling means 6, in particular the driving circuit 62.

Preferably, the power supply circuit 82 comprises one or more converter circuits that are electrically connected to the mentioned interface circuits of the power harvesting circuit 81.

Preferably, the accessory module 64, which accommodates the signalling means 6, defines an internal volume, in which the current transformers of the sensing means 11 and of the power harvesting circuit 81 are positioned as well.

Preferably, the switching device 1 comprises a conductive casing 9 that is electrically connected to the electric contacts 2, 3.

The conductive casing 9 accommodates the control unit 5, the communication unit 13 and, at least partially, the release means 4.

The conductive casing 9 is electrically connected to the conductor P of the power distribution line through the electric contacts 2, 3 to allow the passage of current towards between these latter.

Preferably, the accessory module 64 is operatively connected to the conductive casing 9.

Preferably, the accessory module 64 has a toroid shape defining a passing cavity through which the conductive casing 9 is positioned.

In a further aspect, the present invention comprises a MV switching apparatus 101 comprising a plurality of switching devices 1 (FIG. 1).

In the switching apparatus 101, each switching device 1 is operatively associated to a conductor of the electric power distribution network 100.

Preferably, the switching apparatus 101 is a disconnecting apparatus for an overhead line 100 comprising a plurality of sectionalizers 1, each of which is operatively associated to a phase conductor $P_1$, $P_2$, $P_3$ of the overhead line.

The switching device 1, according to the invention, has remarkable advantages with respect to the state of the art.

Thanks to the signalling means 6, the switching device 1 is capable of providing a self-diagnostic visual indication of its operative status at different periods of its operating life, in particular at the start-up functioning and during its normal operation.

An operator can visually learn whether the installation of the switching device 1 has been successful before the switching device 1 enters into service. It is thus possible to immediately intervene on the switching device 1 in case malfunctions are signalled.

Further, during the normal functioning of the switching device, an operator can easily acquire information about the operative status of the switching device 1, e.g. information about the current flowing along the conductor P.

This allows improving the operating management of the switching device 1 and reducing maintenance time and costs.

The switching device 1 is particularly adapted for being employed in an overhead line 100, in particular to be operatively associated to a phase conductor P1, P2, P3 thereof.

The switching device 1 is of relatively easy and cost-effective realization at industrial level and practical implementation on the field.

The invention claimed is:

1. A switching device for a medium voltage (MV) electric power distribution network, said switching device comprising:

electric contacts electrically connectable to a conductor of said electric power distribution network;

a conductive casing structured to enclose a control unit for managing the operation of said switching device including manoeuvring the electric contacts, said control unit comprises a digital processing device and a memory; and an accessory module including an outer housing structured to enclose a signalling means operatively connected to said control unit, said signalling means comprising a light source adapted to emit visible light observable externally to said switching device through an optical lens of the outer housing, the outer housing including a passing cavity through which the conductive casing is positioned, the outer housing including a first portion having a first outer radius and a second portion having a second outer radius, the first outer radius being greater than the second outer radius, the first portion including an end including the optical lens, the optical lens being positioned to emit the visible light in a direction parallel with the passing cavity, wherein said control unit is configured to control the light source to emit first pulsed light signals using duty cycles of first control signals, each duty cycle being configured to provide coded information indicative of corresponding first operating conditions of said switching device during a start-up functioning of said switching device, and wherein said control unit is configured to control the light source to emit second pulsed light signals using time distributions of second control signals, each time distribution being configured to provide coded information indicative of corresponding second operating conditions of said switching device during a normal functioning of said switching device.

2. The switching device according to claim 1, which further comprises first sensing means including a current transformer operatively connected to said control unit, said first sensing means providing first sensing signals, which are indicative of the current flowing along said conductor, to said control unit, said control unit being adapted to provide said second control signals to control said signalling means in response to said first sensing signals, so that said light source emits second pulsed light signals having one or more second sequences of light pulses indicative of corresponding ranges of values of the current flowing along said conductor.

3. The switching device according to claim 1, wherein the control unit is configured to determine the second operating conditions, and wherein the second operating conditions include a manoeuvring of the switching device or electric power balance across a line branch of the MV electric power distribution network.

4. The switching device according to claim 1, wherein medium voltage includes a voltage higher than 1 kV and lower than 72 kV.

5. A switching device for a medium voltage (MV) electric power distribution network, said switching device comprising:

electric contacts electrically connectable to a conductor of said electric power distribution network;

a conductive casing structured to enclose a control unit for managing the operation of said switching device including manoeuvring the electric contacts, said control unit comprises a digital processing device and a memory; and an accessory module including an outer housing structured to enclose a signalling means operatively connected to said control unit, said signalling means comprising a light source adapted to emit visible light observable externally to said switching device through an optical lens of the outer housing, the outer housing including a passing cavity through which the conductive casing is positioned, the outer housing including a first portion having a first outer radius and a second portion having a second outer radius, the first outer radius being greater than the second outer radius, the optical lens being positioned to emit the visible light in a direction parallel with the passing cavity from an end of the first portion, wherein the control unit is configured to determine first operating conditions of said switching device during a start-up functioning of said switching device, the first operation conditions including a plurality of typologies of faults occurring during the start-up functioning of said switching device, wherein said control unit is configured to control the light source to emit first pulsed light signals using first time distributions of first control signals, each first time distribution being configured to provide coded information indicative of the corresponding first operating condition, wherein the control unit is configured to determine second operating conditions of said switching device during a normal functioning of said switching device including a manoeuvring of the switching device or electric power balance across a line branch of the MV electric power distribution network, and wherein said control unit is configured to control the light source to emit second pulsed light signals using second time distributions of second control signals, each second time distribution being configured to provide coded information indicative of the corresponding second operating condition.

6. The switching device according to claim 5, which further comprises first sensing means including a current transformer operatively connected to said control unit, said first sensing means providing first sensing signals, which are indicative of the current flowing along said conductor, to said control unit, said control unit being adapted to provide said second control signals to control said signalling means in response to said first sensing signals, so that said light source emits second pulsed light signals having one or more second sequences of light pulses indicative of corresponding ranges of values of the current flowing along said conductor.

7. The switching device according to claim 5, wherein the control unit controls the lights source with the first control signals such that the first time distributions are duty cycles, and wherein the duty cycles are configured to provide the coded information indicative of corresponding first operating conditions, or wherein the switching device according to claim 1, wherein the control unit controls the lights source with the first control signals such that the first time distributions are signal durations, and wherein the signal durations are configured to provide the coded information indicative of corresponding first operating conditions.

8. The switching device according to claim 1, wherein the signalling means are located within the first portion.

9. The switching device according to claim 8, wherein the accessory module includes an energy harvesting circuit including a first current transformer located within the second portion and a sensing means including a second current transformer located within the second portion.

10. The switching device according to claim 9, the control unit being located within a portion of the passing cavity formed by the second portion of the outer housing.

* * * * *